US009205470B2

(12) United States Patent
McWhorter

(10) Patent No.: US 9,205,470 B2
(45) Date of Patent: Dec. 8, 2015

(54) ROBOTIC TANK CLEANING DEVICE AND METHOD

(76) Inventor: Thomas R. McWhorter, Savannah, GA (US)

( * ) Notice: Subject to any disclaimer, the term of this patent is extended or adjusted under 35 U.S.C. 154(b) by 986 days.

(21) Appl. No.: 13/168,284

(22) Filed: Jun. 24, 2011

(65) Prior Publication Data

US 2011/0315165 A1 Dec. 29, 2011

Related U.S. Application Data

(60) Provisional application No. 61/358,031, filed on Jun. 24, 2010, provisional application No. 61/372,288, filed on Aug. 10, 2010.

(51) Int. Cl.
*B08B 3/00* (2006.01)
*B08B 9/093* (2006.01)

(52) U.S. Cl.
CPC ..... *B08B 9/093* (2013.01)

(58) Field of Classification Search
None
See application file for complete search history.

(56) References Cited

U.S. PATENT DOCUMENTS 5,642,745 A * 7/1997 Landry et al. ..... 134/167 R
2006/0043698 A1* 3/2006 Bridges ..... 280/639

* cited by examiner

*Primary Examiner* — Eric Golightly
(74) *Attorney, Agent, or Firm* — Cantor Colburn LLP

(57) ABSTRACT

A robotic tank cleaning device is described, which comprises a robotic body, at least one motor attached to at least one wheel of the robotic body, and a cleaning head attached to the robotic body. A method of cleaning a tank is also described, which method provides a maneuverable robotic device insertable through an entry point of a tank without entry of personnel therethrough for cleaning of the tank via a cleaning head.

13 Claims, 8 Drawing Sheets

ROBOTIC TANK CLEANING DEVICE AND METHOD

CROSS REFERENCE TO RELATED APPLICATIONS

This present application claims priority to U.S. Provisional Patent Application Ser. No. 61/358,031 filed Jun. 24, 2010; and, U.S. Provisional Patent Application Ser. No. 61/372,288 filed Aug. 10, 2010, the entire contents of which are specifically incorporated by reference herein.

BACKGROUND

The present disclosure relates to a robotic tank cleaning device that is configured to insert into a tank through a point of entry, such as a confined entry point, a manway of a tank car, etc., and maneuver remotely plural interior portions of the tank for cleaning of such interior portions.

Current robotic systems for cleaning tanks (e.g., for removing rubber lining from rail tank cars that carry corrosive commodities so they can be relined and for removing commodity residuals from rail tank cars) either require personnel entering the tank for setup, movement and removal of cleaning systems or simply insert directly in a manway. Only the first type (the type that requires personnel to enter the tank for setup, movement and removal) is effective in cleaning the ends of the tank. The other type (simple insertion into the manway) is not effective, particularly with regard to the ends of the tank. This type is also not effective with regard to tanks that carry difficult to clean commodities, such as latex.

What is needed in the art is a cleaning system that can handle difficult to clean tanks without personnel entering confined spaces.

SUMMARY

The above described and other problems and disadvantages of the prior art are overcome and alleviated by the present exemplary robotic tank cleaning device, which comprises a robotic body, at least one motor attached to at least one wheel of the robotic body, and a cleaning head attached to the robotic body. The robotic body, at least one motor, at least one wheel and said cleaning head are configured to insert through an entry point, e.g., a manway, of a tank. The robotic device further includes a remote control package operative to control maneuvering of the robotic device inside the tank to permit cleaning of plural interior portions of the tank.

In further exemplary embodiments, the robotic device includes an axle, two wheels and a skid. In exemplary embodiments, the axle and the skid are configured to extend from a folded position to a standing position. In such folded configuration, the robotic device is configured to insert through a tank entry point, such as a tank car manway opening. In such standing position, the robotic device is configured to maneuver along a floor portion of the tank (for example, with a leading skid and trailing wheels). Thus, an operator can maneuver the unit around obstructions, such as a siphon pipe within rail tank car, and still effect cleaning of the tank.

In other exemplary embodiments, the robotic device is maneuvered along the floor portion by selective actuation of motors separately associated with multiple wheels (remotely, in exemplary embodiments, by a user outside the tank). Also, in exemplary embodiments, deployable and retractable portions of the robotic device (e.g., skid(s), axle(s), etc.) are moved via use of hydraulic cylinders configured to be remotely activated by a user outside the tank.

In further exemplary embodiments, a cleaning head of the robotic device is configured to attach to a high pressure line to provide a cleaning spray to the interior of the tank. In certain exemplary embodiments, the cleaning line is first inserted and looped within the tank (e.g., when the high pressure hose has a larger bend radius than the entry point allows) before it is attached to the cleaning head. The robotic device is then lowered through the entry in a folded configuration. Wheels, axles and/or skids are then deployed by an operator external to the tank. The robotic device is then maneuvered remotely by the operator to clean the interior of the tank.

The above-discussed and other features and advantages of the present invention will be appreciated and understood by those skilled in the art from the following detailed description and drawings.

BRIEF DESCRIPTION OF THE DRAWINGS

Referring now to the drawings, wherein like elements are numbered alike in the following FIGURES.

DETAILED DESCRIPTION

As was noted above, the present disclosure relates to a robotic tank cleaning device that is configured to insert into a tank through a confined entry and maneuver remotely plural interior portions of the tank for cleaning of such interior portions. The remainder of the specification will refer to an exemplary tank, exemplary tank car or an exemplary rail tank car. However, it should be recognized that the present invention is not so limited, and the term "tank" encompasses any enclosed vessel with an entry point (such as a confined entry, a manway access, etc.). Such "tank" may be used to transport commodities, e.g., on rails, roads, waterways, etc. Such "tank" may also refer to stationary tanks used to store commodities. The "tank" may have any lower surface geometry, e.g., flat, sloped, curved, irregular, etc. The "tank" may also have one or more entry point(s) in any convenient location, including a top or side surface thereof. Thus, the present disclosure is not restricted to exemplary embodiments described below, but instead relates to robotic cleaning of "tanks."

Figure 1:
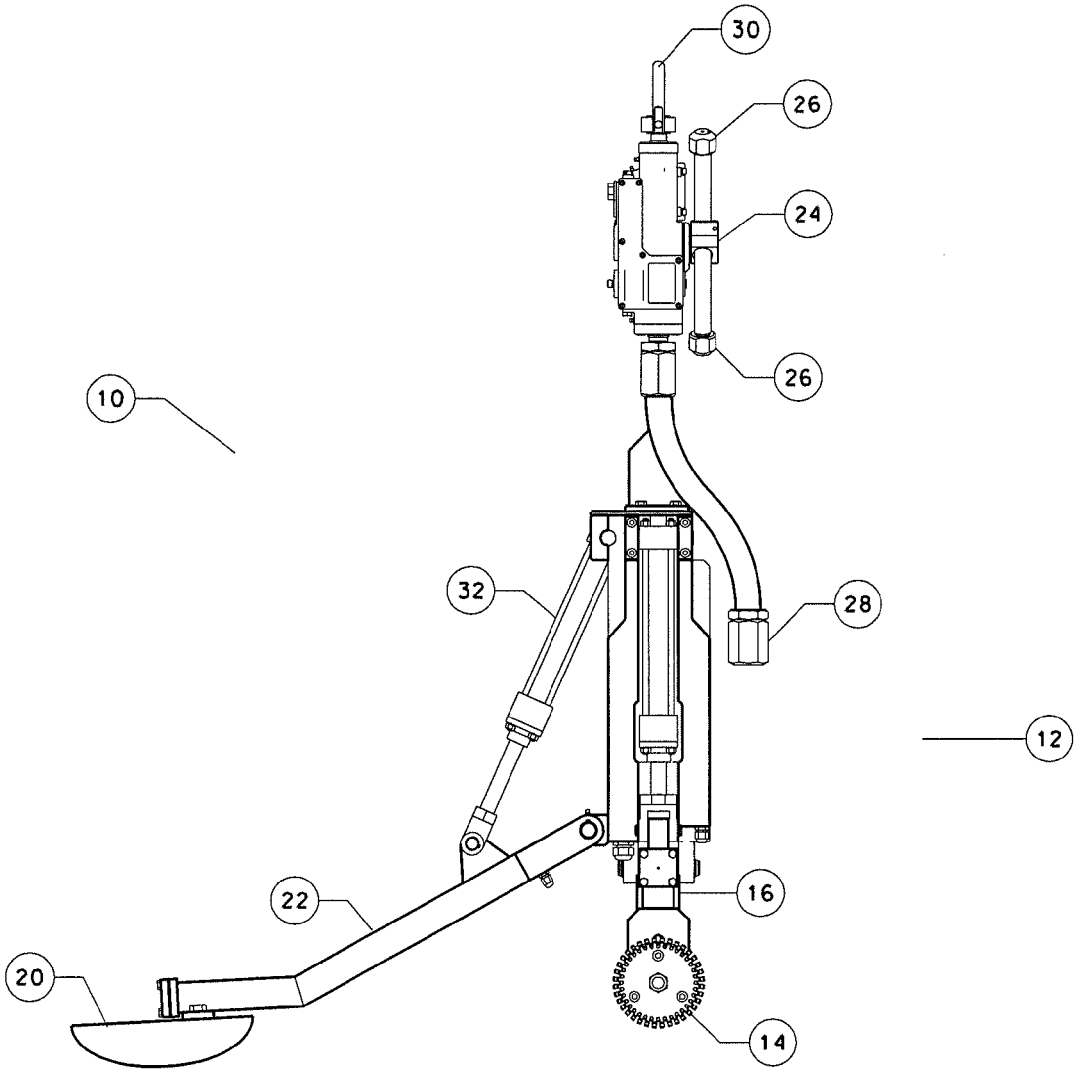
FIG. 1 is a side elevation view of an exemplary standing robotic device for cleaning a tank.
Figure 2:
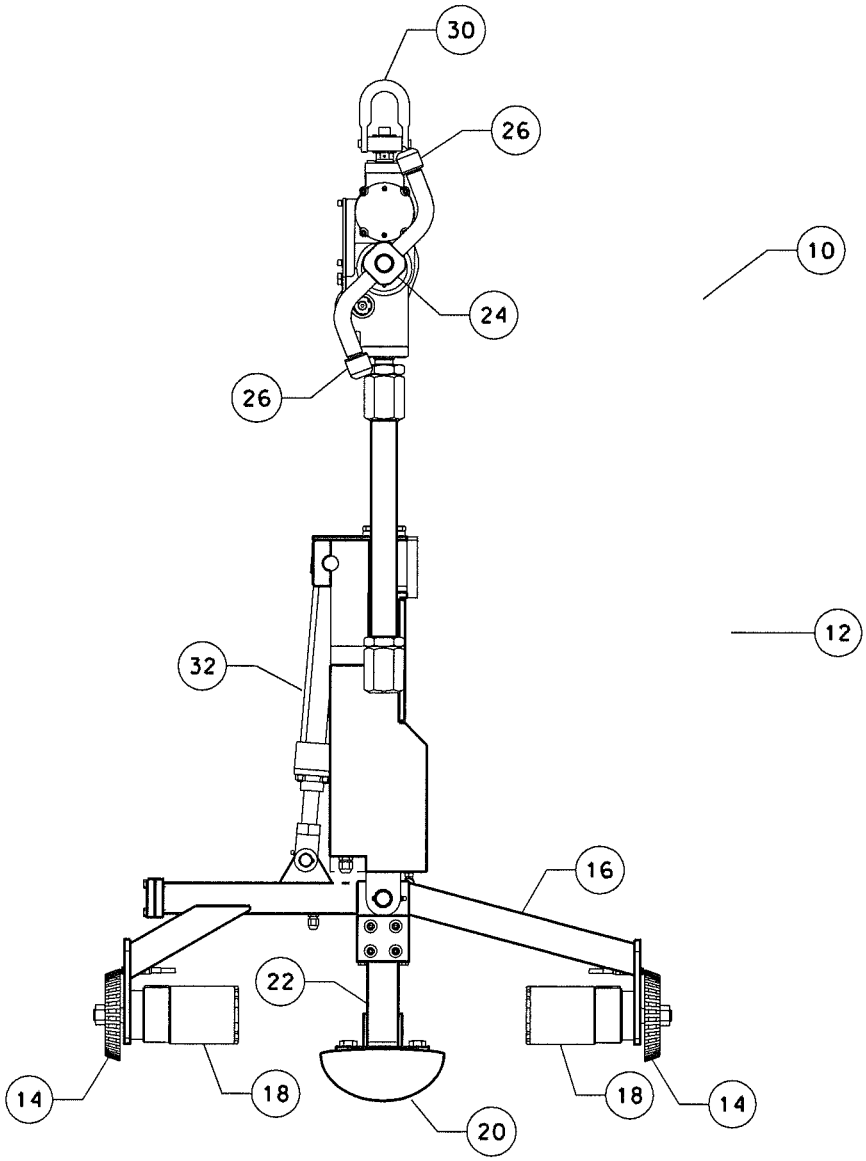
FIG. 2 is a rear elevation view of an exemplary standing robotic device for cleaning a tank.

FIGS. 1 and 2 illustrate an exemplary embodiment of a robotic device in accordance with the present invention in side and rear elevation views, respectively. In this exemplary embodiment, the robotic tank car cleaning device is shown generally at 10. The robotic device 10 comprises a robotic body, shown generally at 12, two wheels 14 connected to the robotic body 12 by an axle 16, and motors 18 associated with each wheel 14. A skid 20 is also connected to the body 12 via a skid support 22.

In the illustrated exemplary embodiment, a cleaning head 24 is also attached to the body 12. The cleaning head includes nozzles 26 configured to output a spray when a high pressure line (not illustrated) is connected to high pressure input 28.

Figure 3:
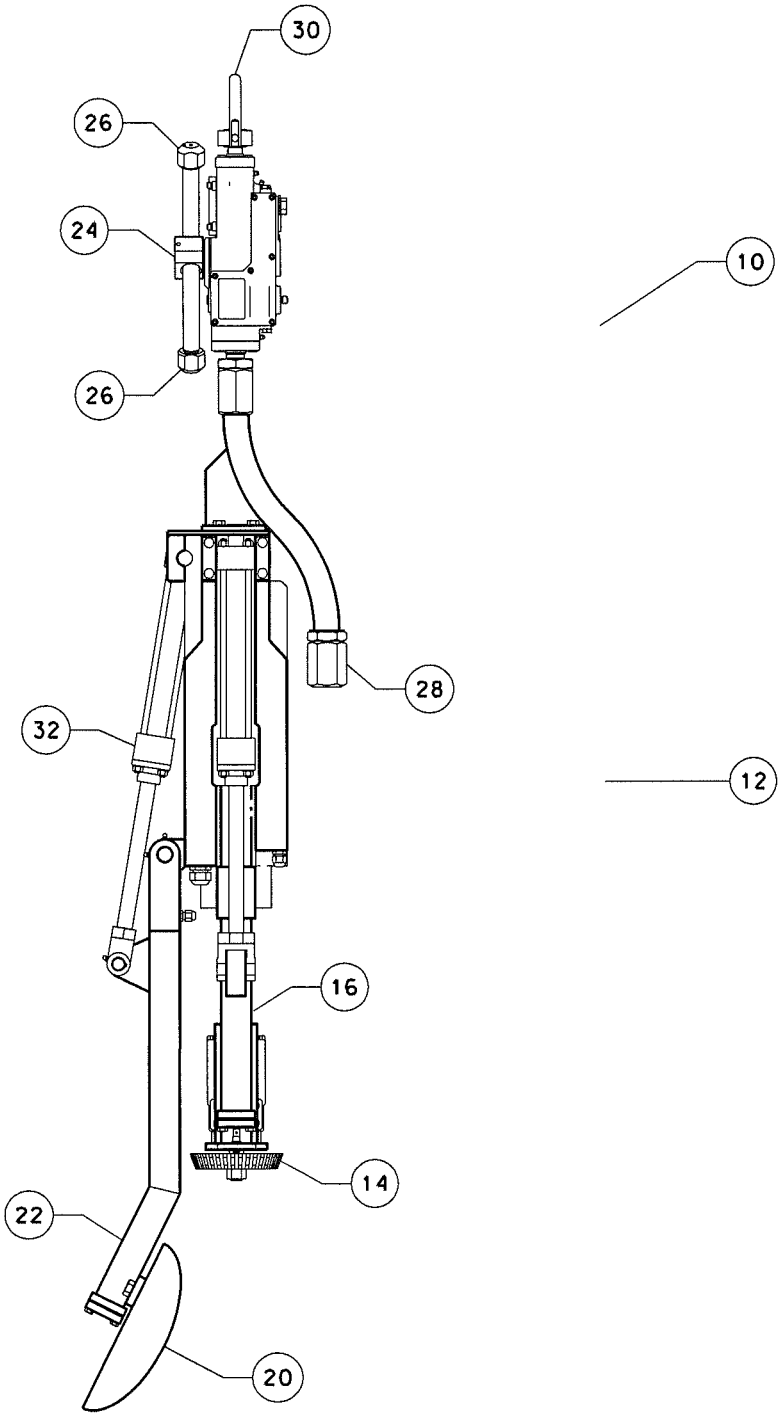
FIG. 3 is a side elevation view of an exemplary folded robotic device for cleaning a tank.
Figure 4:
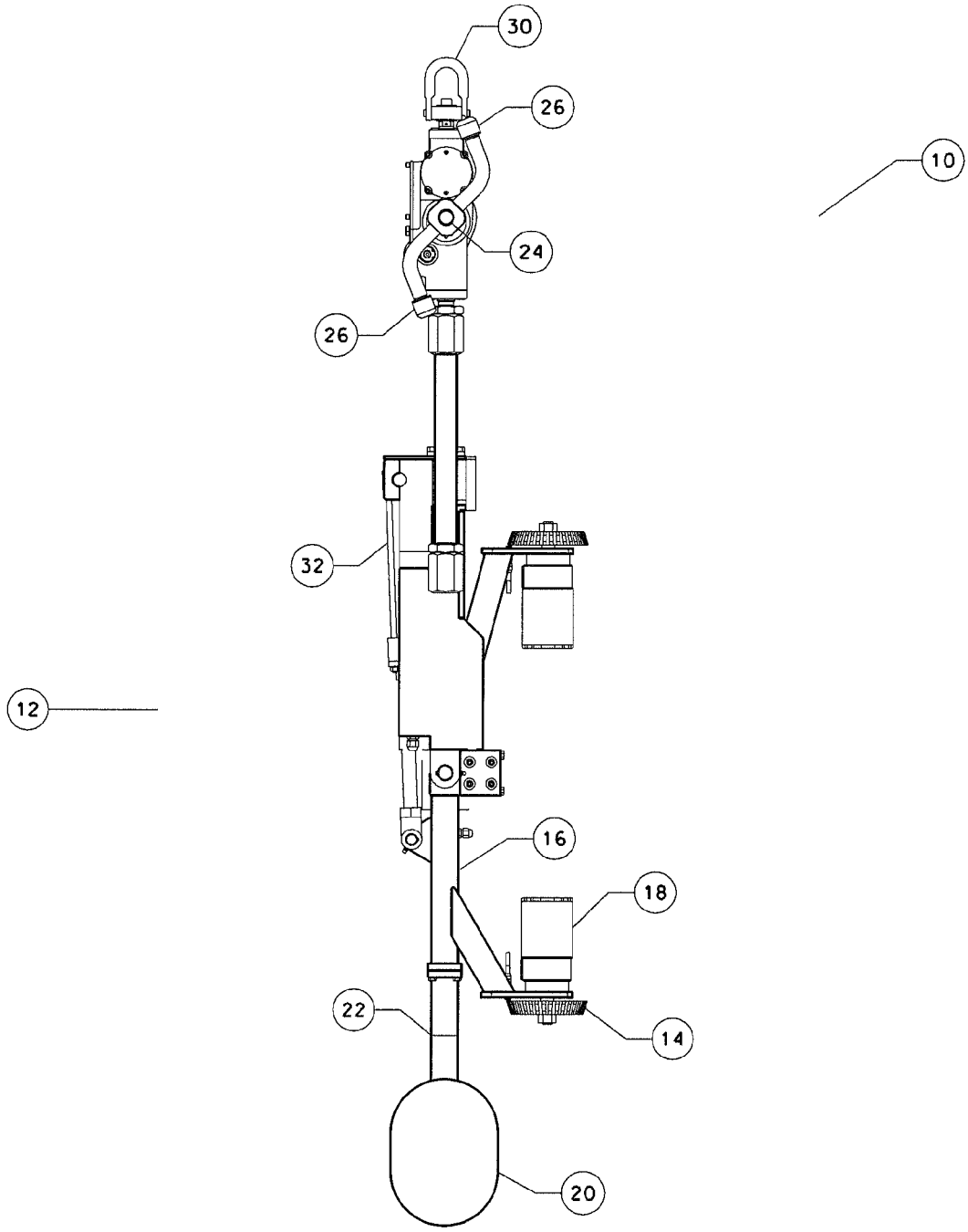
FIG. 4 is a rear elevation view of an exemplary folded robotic device for cleaning a tank.

In the illustrated exemplary embodiment, the robotic device is configured such that it may be hoisted into a tank car via a hoist attachment 30 when the robotic device is in a folded state. The axle 16 and the skid support 22 can be extended and retracted via hydraulic cylinders 32, or by any other convenient mechanism. FIGS. 3 and 4 illustrate side and rear elevation views of the exemplary robotic device of FIGS. 1 and 2 in a folded state.

It should be emphasized that the embodiment shown in FIGS. 1-4 are merely exemplary, and any convenient maneuvering platform, cleaning head, etc. may be used (e.g., using one or plural wheels, one or plural motors, alternative steering mechanisms, no skids or a plurality of skids, etc.).

Figure 5:
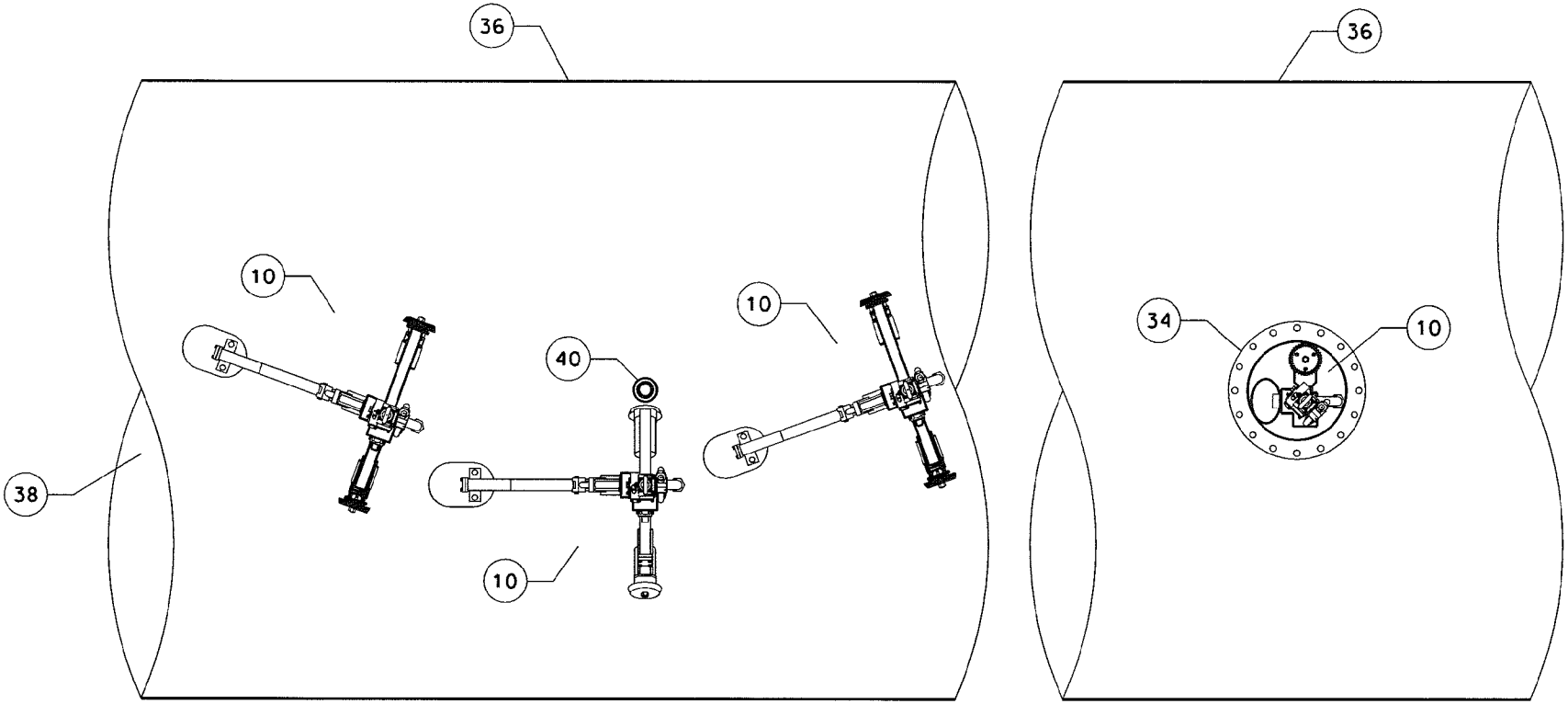
FIG. 5 is a top perspective view of an exemplary folded robotic device positioned in a manway of a tank and a top cutaway view of a standing robotic device in three positions as it maneuvers around an obstruction.
Figure 7:
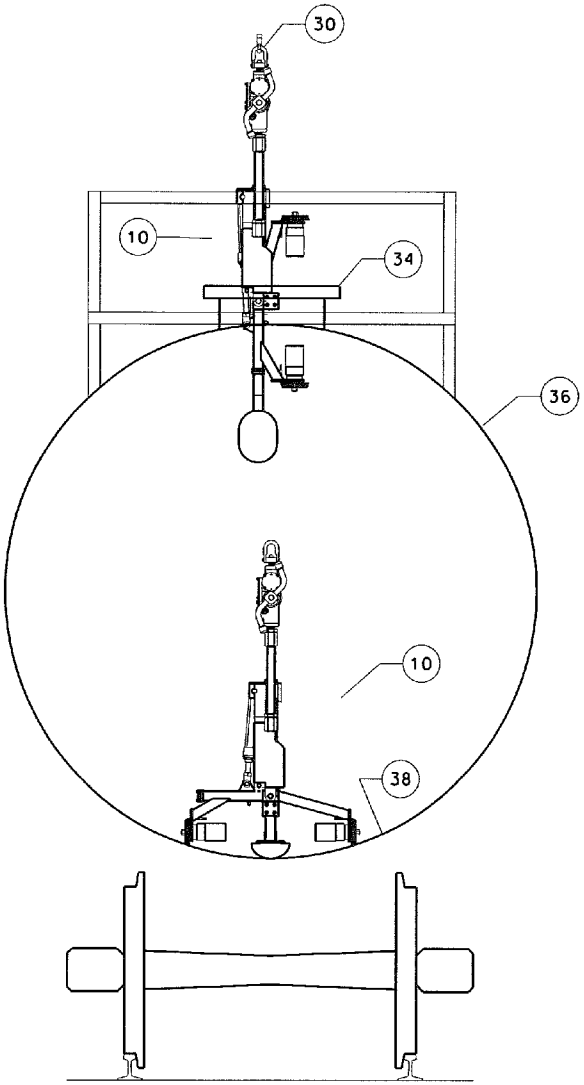
FIG. 7 is a rear cutaway view of an exemplary robotic device positioned in a first folded position in a manway of a tank car and in a second standing position on a lower portion of a tank.
Figure 6:
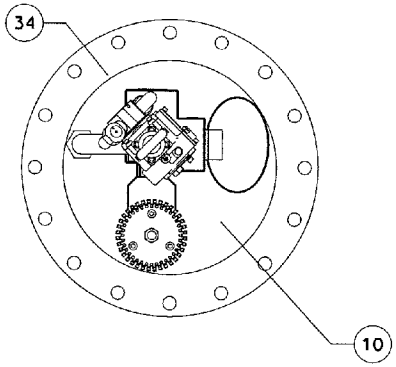
FIG. 6 is a top plan view of an exemplary folded robotic device positioned in a manway of a tank.
Figure 8:
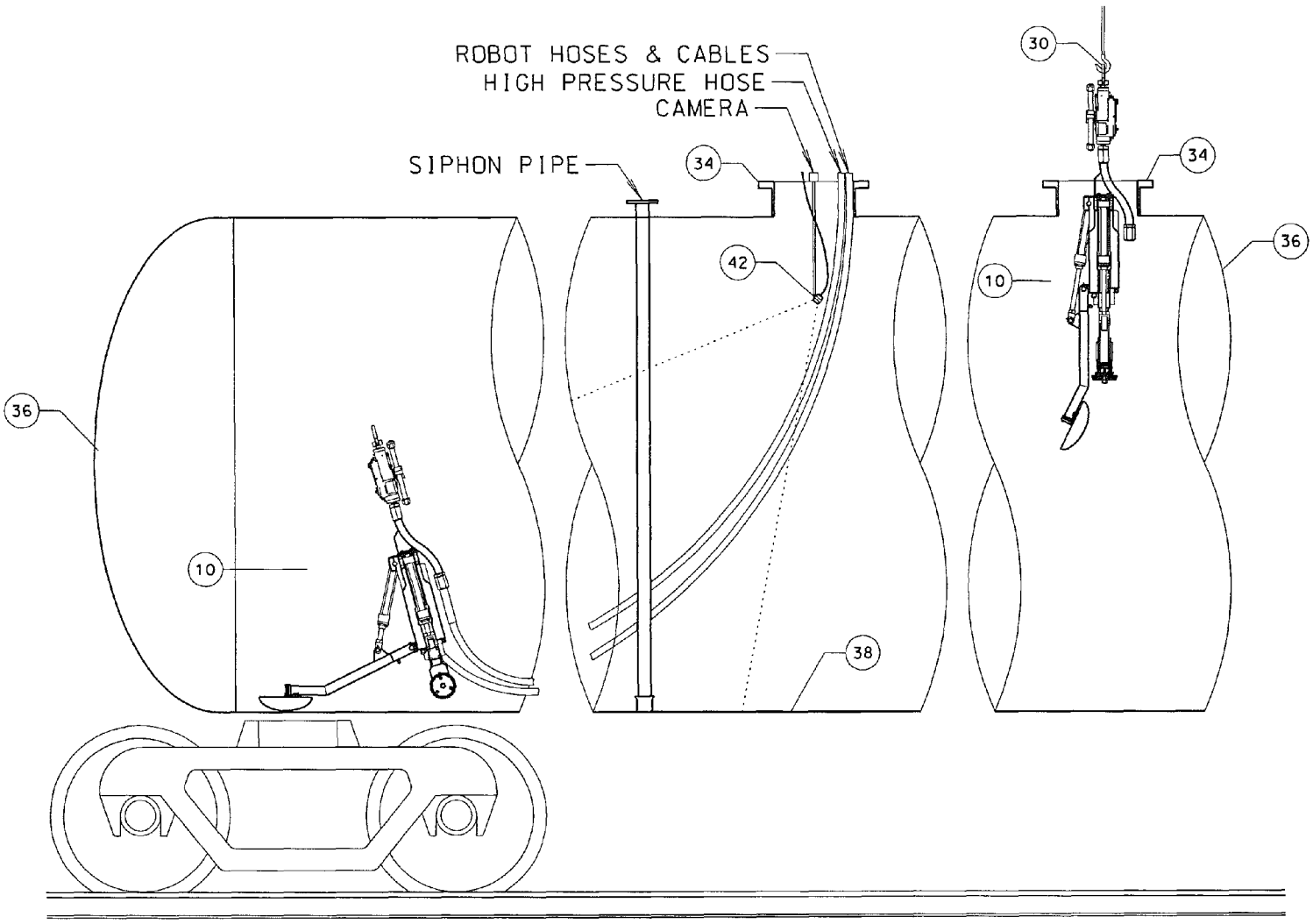
FIG. 8 is a side cutaway view of an exemplary robotic device positioned in a first folded position in a manway of a tank car and in a second standing position on a lower portion of a tank.

FIGS. 5 and 6 show the exemplary robotic device 10 of FIGS. 1-4 in a folded state provided within the diameter of the manway 34 of a tank car 36. FIGS. 7 and 8 also show the exemplary robotic device of FIGS. 1-4 in a folded state being hoisted through a manway 34 of a tank car 36.

Figure 9:
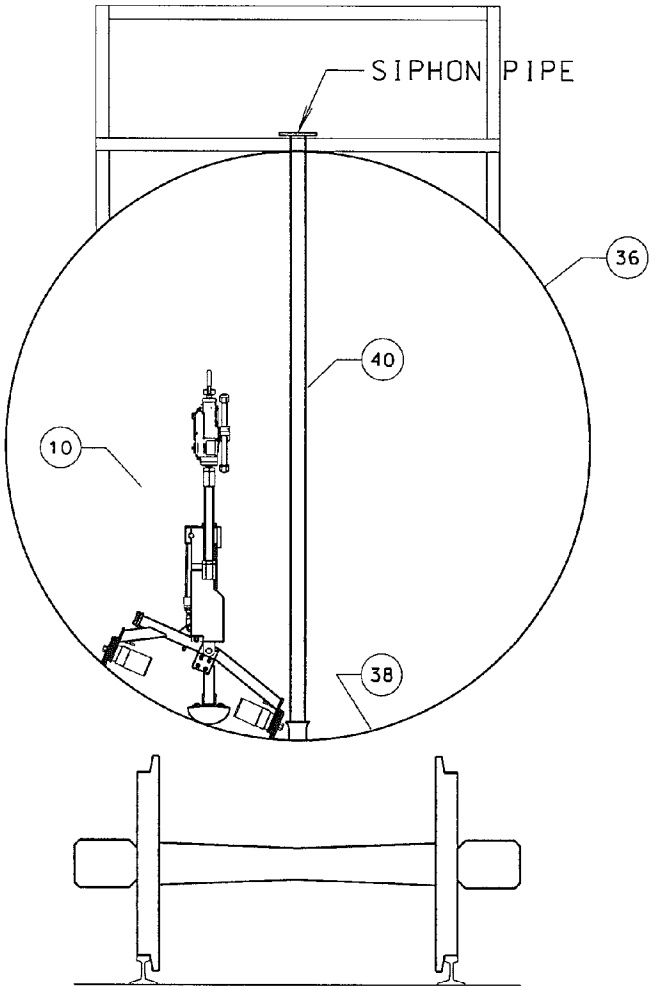
FIG. 9 is a rear cutaway view of an exemplary robotic device positioned in a standing position on a lower portion of a tank as it maneuvers around an obstruction.

FIGS. 5 and 7-9 further show a standing robotic device deployed on a lower surface 38 of a tank car. FIGS. 5 and 9 illustrate the maneuverability of exemplary embodiments of the present disclosure (exemplary embodiments include a motor and a steering configuration and/or at least two motors selectively actuating at least two wheels), wherein the robotic device 10 is configured to maneuver around obstructions, e.g., avoid a siphon pipe 40 obstructing the internal space of the tank car.

FIG. 8 also illustrates the exemplary use of an optional camera 42 to assist an operator in maneuvering a robotic device 10 within a tank car 36. While the camera is illustrated as extending independently through a manway 34, it should be recognized that a camera may be integrated into the robotic device 10 itself.

EXAMPLE 1

An exemplary implementation follows:

In exemplary embodiments, the robotic device may be configured to utilize commercially existing cleaning heads, such as a revolving/rotating cleaning head manufactured by NLB Corporation. In particular, NLB Corporation offers two models of the NLB 3750 cleaning heads that would be convenient for mounting on the robotic device. The dual cleaning action of the revolving/rotating head, powered by the reaction force of the high-pressure water jets, provides complete 360° interior coverage. Model No. NLB3750-40-20K is suitable for operating pressures 3,000 to 20,000 psi with 13-50 gpm flow rate. This model is constructed of bronze and weighs 28 pounds. Model No. NLB3750-85 is suitable for operating pressures 4,000 to 13,000 psi with 80 gpm flow rate. This model is constructed of stainless steel and weighs 48 pounds. The high pressure water supply systems for the cleaning heads are also offered by NLB Corp.

As has been described above, in exemplary embodiments the robotic device may be maneuvered, manually by remote control, to any position along the length of the car and can be maneuvered around obstacles that are within the pathway such as piping, educator guides, or valve stems. In exemplary embodiments, the robotic device may also be folded to inserts into a tank car through manway, which may be in common implementations, e.g., as small as 18 inches in diameter. The robotic device may be inserted, setup, and operated alone in the confined space without entry by personnel. In exemplary embodiments, the robotic device may be moved into position by remote control, may remain in position for a spray cycle (360° rotation of the cleaning head), and then may be repositioned by remote manual control to next spot for cleaning.

In exemplary embodiments utilizing a central body, an axle with two wheels, and a leg with skid, the two wheels and the skid form the three points of contact with the tank car. Also, in exemplary embodiments, the cleaning head may mount directly on the central body, and the body may mount on the wheeled axle at a central pivot point. As has been described by way of example above, an axle may use two wheel motor drives and a skid-style foot on the front of the unit. The skid may be sized to pass over drain outlets without lodging in the opening. In exemplary embodiments, two hydraulic cylinders may be used to hold the position of the body in the planes of the leg and the axle, respectively, with the center of gravity centered between the two wheels and the skid.

During operation, one hydraulic cylinder may be used to hold the body in vertical position in the plane of the axle and the other cylinder may be used to hold the body in a tilted position in the plane of the leg. For insertion into and removal from the tank car, a rod may extend from a hydraulic axle cylinder, pivoting about the central point and rotating the axle from horizontal to vertical until one wheel and half of the axle hangs below the body and the other fits into a recess in the body. For insertion into and removal from the tank car, the rod may extend from the leg cylinder, causing the leg to pivot at the hinge point at the base of the body and rotating the leg downward to vertical position with the skid foot below the body.

Without being limiting, the central body may be formed, e.g., from a single block of 6061-T6 aluminum. Other fabricated parts such as the axle and leg may be, e.g., Type 304 Stainless Steel. The pivot pins may be, e.g., Type 316 Stainless Steel. The fasteners may be, e.g., 18-8 Stainless Steel. In such a configuration, the assembly might weigh, e.g., 232 pounds excluding the cleaning head and high pressure hose adapters/fittings (although lighter weight and heavier weight implementations are contemplated herein, and particular recitations of components and component materials should not be considered a limiting factor). In such an implementation, a hoist may be convenient to lift the robotic tool into and out of the tank cars.

In exemplary embodiments, motors for the wheels and the cylinders may be powered by hydraulic fluid. The hydraulic power pack and valve manifold may be mounted outside the tank cars. In an exemplary implementation, the power pack consists of the 20 gallon oil reservoir, pump, pressure and tank filters, and heat exchanger. Flow control valves for each hydraulic device may be mounted on a manifold block at the pump. Hydraulic fluid flows through individual hoses from the manifold to each device on the robotic device.

In an exemplary implementation, two electrical panels may also be supplied with the robotic device. The panels may be mounted on the work platform. The first panel houses an incoming power supply (480 volt, 3 phase, 20 amp), motor starter for hydraulic pump, transformer, and power supply (120 volt, 1 phase, 12 amp) for second panel. The second panel houses a 24 volt dc power supply, programmable logic controller (PLC), man-machine interface, video display, status lights, alarm horn, selector switches, push-buttons, and emergency stop push-button. A camera may be supplied for insertion through the manway to provide a view on the tank car interior when the operator is maneuvering the tool around obstacles.

The modes of operations/controls may be divided by the tasks to be performed. For example, the operator directly may control the travel and steering when moving around obstacles or between spray points. While the tool is in the car, whether during spray or movement, the vertical alignment of the robot body over the wheel axle and leg can be maintained by the PLC-based control system. The wheel drives may be separately and independently controlled, which allows steering of the tool. The operator can drive the two wheel motors with a single joy stick.

EXAMPLE 2

An exemplary implementation of robotic device setup and operational procedure follows:

The robotic device may be hoisted vertically 2 feet from its upright and parked position on the platform. From a control panel, the operator may lower the front leg and tilt the axle so the body, axle, and leg are in their vertical position. The robot may then be moved near the car manway.

The end of the high pressure hose may be dropped through the manway, looped inside the car, and the end pulled up and attached to the cleaning head (as was described above, this is necessary when the minimum bending radius of the hose is greater than the manway radius, i.e. you cannot attach the hose to the spray and then bend the high pressure hose through the manway with the tool without damaging the hose).

Once the high pressure hose is attached, the robotic device may then be lowered through the manway to the car centerline. From the control panel, the operator can raise the skid leg and rotate the axle to horizontal position. The robotic device may then be lowered to rest on the tank floor and the hoist may be removed from the car. The robot can then be placed under automatic tilt control so that the PLC maintains the vertical alignment of the body.

The operator then drives the robot to a cleaning position at the car head using the joy stick for wheel motion. When in position the robot may be stopped and the first spray cycle is started. When each spray cycle is completed the robot may be moved in reverse to the next spray position. When reaching the manway, the robot can be lifted with the hoist and rotated 180 degrees to clean the opposite end of the car. When complete the robot is removed in the reverse sequence of insertion.

It will be apparent to those skilled in the art that, while exemplary embodiments have been shown and described, various modifications and variations can be made to the robotic tank car cleaning device and method of making disclosed herein without departing from the spirit or scope of the invention. Also, the exemplary implementations described above should be read in a non-limiting fashion, both with regard to construction and methodology. Accordingly, it is to be understood that the various embodiments have been described by way of illustration and not limitation.

What is claimed is:

1. A remotely maneuverable robotic device for cleaning a tank without entry of personnel through an entry point of the tank, comprising:

a robotic body;

at least one wheel connected via a support to said robotic body, wherein said at least one wheel comprises at least one of a plurality of contact point devices extending from said robotic body, the contact point devices configured to support the robotic body on a lower portion of a tank;

at least one motor associated with said at least one wheel, the plurality of contact points and said at least one motor configured with and connected to a remote package external of said tank to provide remote maneuverability of said robotic device along the lower portion of said tank, wherein said plurality of contact point devices are configured to deploy to a standing state permitting support of said robotic body on said lower portion of said tank and to a folded state, wherein the diameter of said robotic device is reduced to permit insertion and withdrawal of the robotic device through an entry point of said tank; and a cleaning head operatively associated with a pressurized fluid source, the cleaning head configured to distribute pressurized fluid and the robotic device configured to move the cleaning head to plural positions within said tank for cleaning at said plural positions wherein for insertion into and removal from a tank, a rod extends from a hydraulic axle cylinder, pivoting about a central point and rotating the axle between a horizontal configuration and a vertical configuration, wherein in said vertical configuration one wheel and a first portion of an axle hangs below the body.

2. A remotely maneuverable robotic device in accordance with claim 1, wherein said robotic device comprises at least one axle, at least two wheels and at least one skid on a leg, the axle and the skid configured to extend from a folded position into a standing position.

3. A remotely maneuverable robotic device in accordance with claim 1, wherein said folded diameter is at or less than about 18 inches.

4. A remotely maneuverable robotic device in accordance with claim 2, further comprising a first hydraulic cylinder configured to hold the body in a vertical position in the plane of the axle and a second hydraulic cylinder configured to hold the body in a tilted position in the plane of the leg.

5. A remotely maneuverable robotic device in accordance with claim 1, wherein said cleaning head mounts to a central body portion and wherein the body is mounted to a wheeled axle at a central pivot point.

6. A remotely maneuverable robotic device in accordance with claim 2, wherein said skid is sized to pass over drain outlets without lodging in openings.

7. A remotely maneuverable robotic device in accordance with claim 1, wherein in said vertical configuration a second wheel and a second portion of the axle fits into a recess in the body.

8. A remotely maneuverable robotic device in accordance with claim 2, wherein a rod extends from a leg cylinder, causing the leg to pivot at a hinge point at a base portion of the body and rotating the leg downward to a vertical position with the skid below the body.

9. A remotely maneuverable robotic device in accordance with claim 1, wherein said robotic body is configured with a hoist attachment to attach to a hoist configured to lift the robotic device into and out of tank cars in a vertical position.

10. A remotely maneuverable robotic device in accordance with claim 2, further comprising a programmable logic control component with automatic tilt control configured to control alignment of the robot body over the axle and leg.

11. A remotely maneuverable robotic device in accordance with claim 1, further comprising a hydraulic power pack and valve manifold configured to be mounted outside the tank, the power pack including an oil reservoir, pump, pressure and tank filters and a heat exchanger.

12. A remotely maneuverable robotic device in accordance with claim 1, further comprising a camera configured for insertion through a manway to provide a view of the tank car interior when an operator is maneuvering the robot device around obstacles.

13. A remotely maneuverable robotic device in accordance with claim 1, further comprising a camera attached to said body.

* * * * *